United States Patent [19]

Vaughan et al.

[11] 4,129,907

[45] Dec. 19, 1978

[54] TOILET SEAT HANDLE

[76] Inventors: Paul R. Vaughan; Susan E. Vaughan, both of 4646 Budd Dr., Erie, Pa. 16506

[21] Appl. No.: 818,405

[22] Filed: Jul. 25, 1977

[51] Int. Cl.[2] ..... A47L 13/10

[52] U.S. Cl. ..... 4/251; 4/237; 16/121

[58] Field of Search ..... 4/251, 237, 1; 16/121

[56] References Cited

U.S. PATENT DOCUMENTS

| | | | |
|---|---|---|---|
| 434,650 | 8/1890 | Adams | 16/121 |
| 630,675 | 8/1899 | Ferrall | 16/121 |
| 2,758,315 | 8/1956 | Hylton | 4/251 |
| 3,717,884 | 2/1973 | Mantooth | 4/251 |
| 3,935,601 | 2/1976 | Hermann | 4/251 |

*Primary Examiner*—Richard E. Aegerter
*Assistant Examiner*—L. Footland
*Attorney, Agent, or Firm*—Charles L. Lovercheck

EXEMPLARY CLAIM

A toilet seat operating assembly for protecting the hands of a user of the toilet against bacteria. The operating assembly is adapted to be attached to a toilet seat and includes a spherical hand-engaging portion which can be readily removed for cleaning and sanitizing.

1 Claim, 5 Drawing Figures

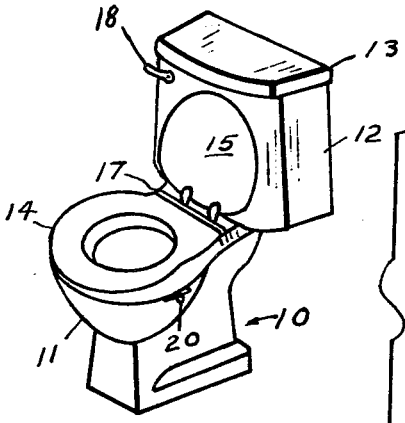
FIG. 1.
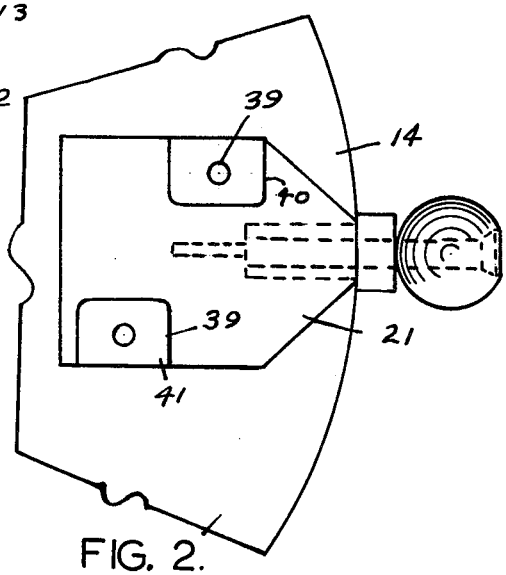
FIG. 2.
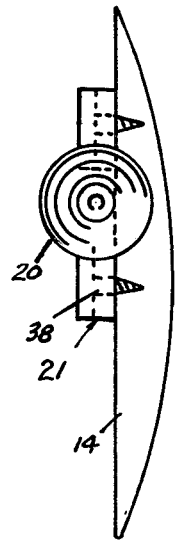
FIG. 3
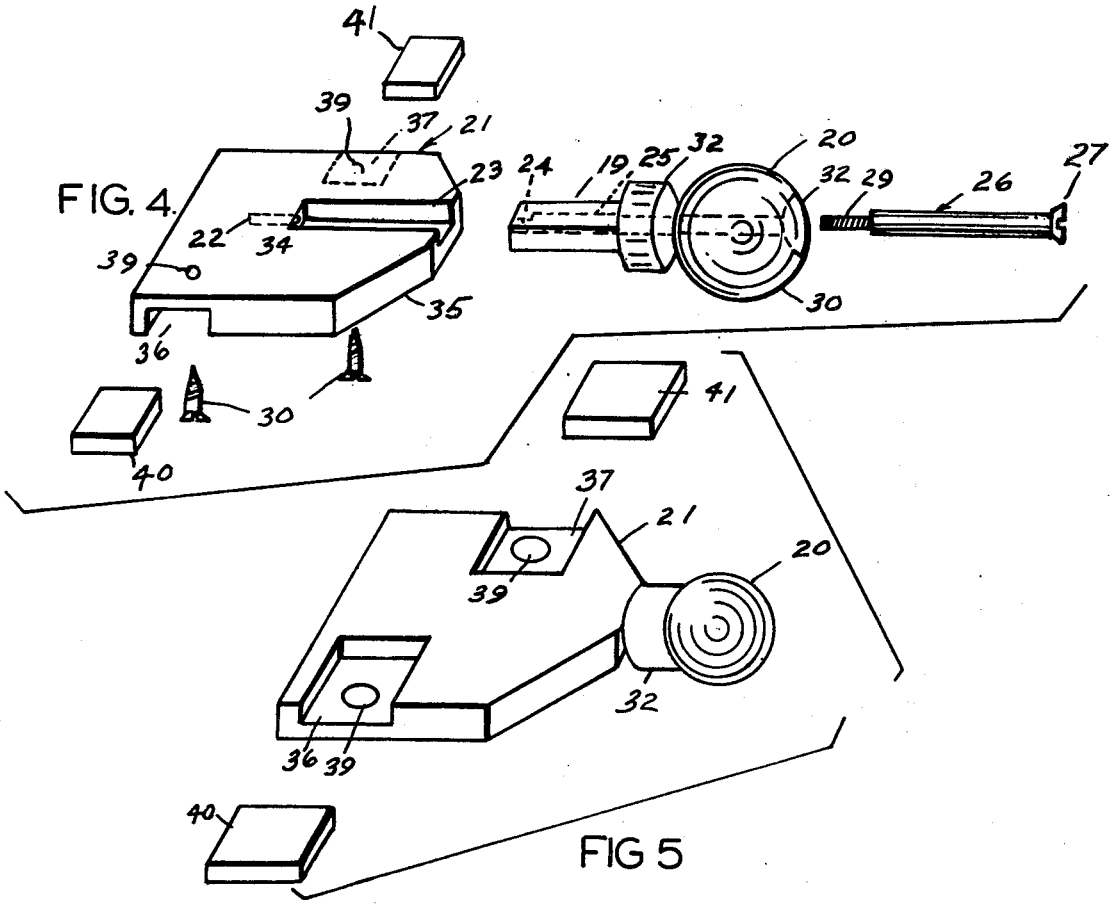
FIG. 4.
FIG 5

TOILET SEAT HANDLE

GENERAL DESCRIPTION OF THE INVENTION

Many types of handles and brackets have been proposed for operating toilet seat assemblies where the hand of the user is protected to some extent from the surface of the seat of the assembly, however, these previous devices have failed to provide a readily removable means which can be thoroughly cleansed and sanitized to protect the user.

REFERENCE TO PRIOR ART

The invention disclosed herein constitutes an improvement over U.S. Pat. Nos. 3,783,455; 3,191,193; 3,935,601 and 3,717,884.

OBJECTS OF THE INVENTION

It is an object of the invention to provide an improved toilet seat operating mechanism.

Another object of the invention is to provide a sanitary toilet seat operating mechanism which is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims it being understood that the changes may be made in the form, size, proportions and minor details of construction without departing from the spirit of sacrificing any of the advantages of the invention.

GENERAL DESCRIPTION OF THE DRAWINGS

FIG. 1 is an isometric view of the toilet seat operating mechanism in combination with a toilet according to the invention.

FIG. 2 is an enlarged partial bottom view of the operating mechanism on the toilet seat.

FIG. 3 is a side view of the toilet seat operating mechanism according to the invention.

FIG. 4 is an exploded view taken from the top of the toilet seat operating mechanism according to the invention.

FIG. 5 is another exploded view of the operating mechanism according to the invention.

DETAILED DESCRIPTION OF THE DRAWINGS

Now, with more particular reference to the drawings, in FIGS. 1–5, a commode of the usual type indicated generally at 10 is shown having a bowl 11, a flush tank 12 with lid 13 and seat assembly 14 and a cover 15. The seat is hinged to the commode by means of a pin 17. The commode has a flush handle 18.

The handle assembly 20 has an arm 19 which fits into a groove 23 in the mounting plate 21. The mounting plate has a threaded opening 22 in the inner end of the groove 23 and the groove 23 receives the arm 19. The arm 19 has an unthreaded bore 24 which aligns with the threaded bore 22 in the plate 21. The bore 24 is counterbored at 25 and this counterbore receives the cylindrical body of the pin 26. Pin 26 has head 27 and a threaded reduced size in 29 which is threadably received in the threaded hole 22. The ball 30, the bore 31 and a countersink 32 receive the head 27 of the pin 26. The arm 19 has the flange 32 integrally fixed thereon and the ball is freely rotatable on the pin 26 and is supported between the flange 32 and the head 27. The mounting plate 21 has a flat upper side 34 and a flat lower side 35 and square openings 36 and 37 are formed in the lower side of the mounting plate. When the screws 38 are inserted in the countersunk holes 39, the cover plates 40 and 41 form a frictional engagement with the side edges of the recesses.

It will be noted that the pin 26 can be readily removed with an ordinary screwdriver so that the ball 30 can be removed and thoroughly cleaned and sanitized to prevent the accumulation of bacteria and dirt.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a water closet having a seat and a handle assembly attached to one side of said seat for lifting said seat, said handle assembly comprising, a mounting plate having two flat sides, two edges and two ends, a rectangular groove in one said flat side and extending through one end and two spaced rectangular notches in the side of said plate opposite said groove, said groove and said notches each extending approximately half-way through said mounting plate, spaced countersunk holes in said mounting plate extending from the bottom of each said notch through said plate, one end of each said hole terminating at said notches in a countersunk hole, a flat-head screw in each said hole attaching said mounting plate to said seat, a rectangular block fitted into each said notch, an arm received in said groove between said mounting plate and said seat, a counterbored hole in said arm, said arm terminating at the end remote from said mounting plate in a cylindrical member, a spherical member, said spherical member having a bore therethrough, one end of said bore in said spherical member being countersunk, a pin extending through said bore in said spherical member, through said counterbored hole in said arm and having a threaded end engaging a threaded hole in said mounting plate, said pin having a shoulder adjacent said threaded end engaging a shoulder on said arm holding said arm to said mounting plate in fixed position.

* * * * *